United States Patent [19]

Geneve et al.

[11] Patent Number: 4,556,253

[45] Date of Patent: Dec. 3, 1985

[54] DISPOSABLE CHAIR

[75] Inventors: Francois M. Geneve; Luc M. D. Heiligenstein; Stephen B. Melamed, all of Chicago, Ill.

[73] Assignee: Tres Design Co., Inc., Chicago, Ill.

[21] Appl. No.: 498,749

[22] Filed: May 27, 1983

[51] Int. Cl.[4] ..... A47C 4/00

[52] U.S. Cl. ..... 297/440; 248/174; 297/442

[58] Field of Search ..... 248/174; 297/440, 443, 297/442, 444; 206/326

[56] References Cited

U.S. PATENT DOCUMENTS

| | | | |
|---|---|---|---|
| 1,896,721 | 2/1933 | Richards | 248/174 X |
| 2,049,659 | 8/1936 | Parrott | 297/442 |
| 2,188,602 | 1/1940 | Hall | 248/174 X |
| 2,771,260 | 11/1956 | Thom | 248/174 X |
| 3,021,042 | 2/1962 | Stumpf, Jr. | 248/174 X |
| 3,126,140 | 3/1964 | Lizan et al. | 297/442 X |
| 3,178,227 | 4/1965 | Snyder | 297/440 |
| 3,220,362 | 11/1965 | Downes | 297/440 X |
| 3,556,593 | 1/1971 | Speegle | 297/442 |
| 3,606,459 | 9/1971 | Krone | 297/440 |
| 3,727,979 | 4/1973 | Schier et al. | 297/440 |

*Primary Examiner*—William E. Lyddane
*Assistant Examiner*—James R. Brittain, Jr.
*Attorney, Agent, or Firm*—Jacques M. Dulin, Ltd.

[57] ABSTRACT

Lightweight chair from a single unitary die-cut and scored generally rectangular blank of sheet material which is collapsible for easy storing and carrying, and which pops open for easy set-up. The lower 10–20% of the blank has a plurality of flaps gulable to the inner face of adjoining sidewall panels to form a reinforced base perimeter. Half of the blank forms the chair base sidewalls, and the remaining upper half forms a pair of adjoining seat/back panels which are delineated from the sidewalls by a set of generally W-shaped score lines. An assembly tab at one end is fastened to the opposite side of the other end of the blank to form in cross-section an enclosed polygon, preferably a modified hexagon of unequal sides. A first of the pair of seat/back panel assemblies is folded down with one or more tabs or flaps frictionally engaging one or more of the sidewall panels. Then the second of the pair of seat/back panel assemblies is folded over the first, and an interlocking tab engages a slot in the first to complete the assembly. In use the seat is oriented with one of the polygon (hexagon) corners forward to provide leg room on either side. A generally triangular or trapezoidal backrest panel is joined to a generally rectangular middle seat panel, and the seat portion in joined in turn to a generally triangular legrest panel.

29 Claims, 13 Drawing Figures

Fig. 1
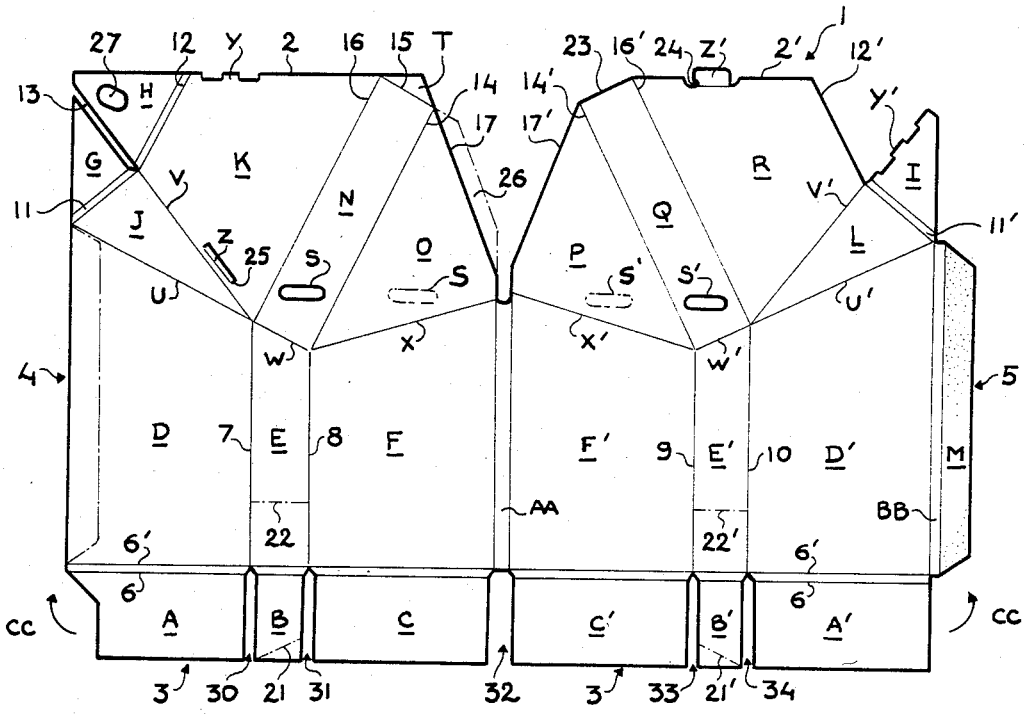
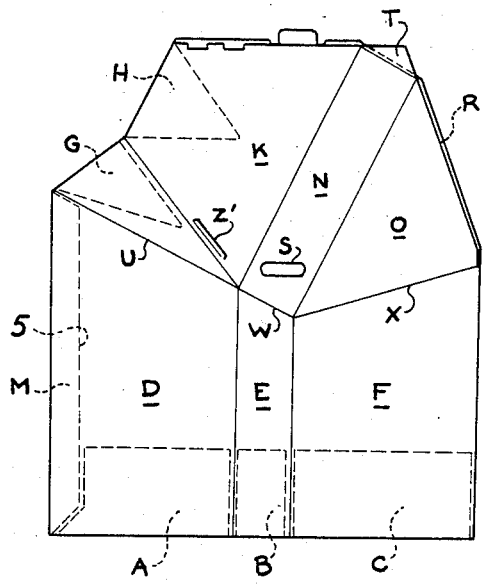
Fig. 2a
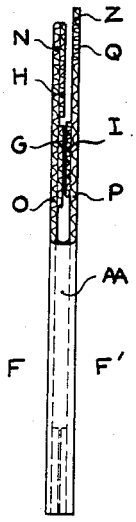
Fig. 2c
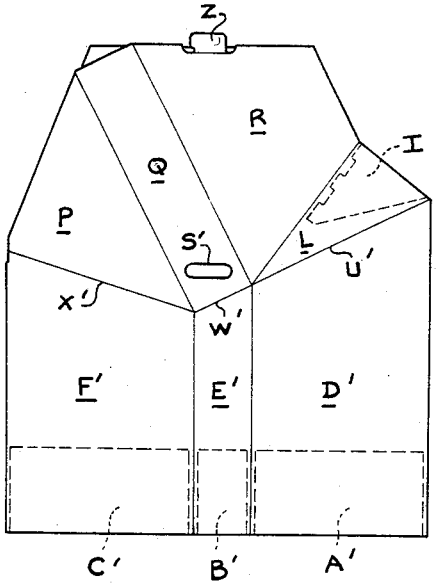
Fig. 2b

Section 6-6 section 7-7

DISPOSABLE CHAIR

FIELD OF THE INVENTION

This invention relates to an article of furniture, and more particularly to a lightweight chair made from sheet material which is collapsible for easy storing and carrying, yet which is simple to manufacture and set up and sufficiently inexpensive to be disposable, preferably in a manner in which its materials can be recycled, and which is assembled from a single die-cut and scored blank.

BACKGROUND OF THE INVENTION

There have been many attempts in the prior art to fabricate lightweight chairs and other furniture items from corrugated cardboard. While such cardboard materials have a relatively brief useful lifespan because they are not inherently highly durable, the low cost of the materials and methods of manufacture have resulted in relatively inexpensive chairs, thus justifying the relatively short useful lifespan.

Exemplary of the art in this field are the following patents: Steuer U.S. Pat. No. 3,149,880; Snyder U.S. Pat. No. 3,178,227; Downes U.S. Pat. No. 3,220,362; Giebel U.S. Pat. No. 3,463,546; Caigan U.S. Pat. No. 3,604,751; and Klein U.S. Pat. No. 4,085,970. To our knowledge, none of these has met with general acceptance or marketing success which we believe may be due to the relative complexity of these chairs in terms of the blank layout and material wastage, the difficulty of "set-up" or assembly of the chairs by the consumer at the time of use, the difficulty in disassembly for storage (they are not easy to knock down for storage), and relatively poor seating comfort. While complex or multi-part blanks are difficult to set up and knock down for storage or shipping, they also very significantly increase the cost, thus making them unattractive to the consumer in view of their very short lifespan.

To our knowledge, there is no single-use, lightweight, portable chair which is fabricated from a single, standard-size sheet of relatively rigid material to form a chair that is inexpensive, simple to manufacture, can be easily set up and knocked down, is easy to carry, and is ergonomically comfortable.

Accordingly, there is a need in the art to provide such type of chair which is economic even from a single-use point of view for outdoor festivals, special events, or any other situation in which large crowds gather for a relatively short period of time where there is no immediate seating readily available. Such use extends to campgrounds, parks, garden parties, barbecues, picnics, beach usage, and the like, where it is desirable to provide inexpensive seating for limited use and which may be conveniently disposed-of when desired, or knocked down to flat form for transport and storage. Another important use is for children's furniture as children, during growth years, need various sizes of furniture before being able to be comfortable in adult-sized furniture. In addition, this type of furniture would be useful in children's playrooms or parties as it will save wear and soiling of other household furniture.

THE INVENTION

Objects

It is among the objects of this invention to provide a chair fabricated from a single, standard-sized sheet of a lightweight, high-strength, relatively rigid material in sheet form such as cardboard, fiberboard or plastic.

It is another object of this invention to provide an improved disposable chair which is formed from a one-piece die-cut and prescored blank in which all the chair elements are integrally connected.

It is another object of this invention to provide a preassembled chair unit which can be folded flat either for shipping or storage, and which pops open for easy set-up of the chair for use.

It is another object of this invention to provide a preassembled chair unit which can be set up in a few, very simple and quickly performed manual steps without the use of any tools.

It is another object of this invention to provide a blank and resulting preassembled chair unit of a lightweight, high-strength, relatively rigid sheet material which can be produced in various sizes ranging from children's size to adult size.

It is still another object of this invention to provide a preassembled disposable chair which has a handhold specially disposed therein for ease of carrying.

It is another object of this invention to provide a preassembled, pop-open chair unit which is ergonomically designed to provide optimum comfort and lumbar (lower back) support for continuous seating over an extended period of time yet is able to safely accommodate a variety of human sizes and weights.

It is another object of this invention to provide a blank for a disposable chair, and the preassembled chair unit made from said blank, which can be coated with a variety of coatings such as waterproofing or graphics to render the chair resistant to moisture damage and allowing for extensive areas on the chair for advertising or promotional purposes.

It is another object of this invention to provide a blank for a disposable chair which is simple to manufacture, preassemble and use, yet which is sufficiently cheap that the chair may be sold for one-time usage for promotional purposes.

It is still another object of the invention to provide a means for retaining a trash bag in association with a disposable chair so that users may conveniently dispose of trash in the chair while at use at concerts, picnics and the like, and which can then be easily disposed of either separately or along with the chair at the end of the event.

Still further and other objects of this invention will be evident from the description and drawings.

SUMMARY

A one-piece blank is die cut from a standard width (for an adult chair) of corrugated cardboard. The blank is generally rectangular with panels defined therein by joined score lines. The lower 10–20% of the blank is separated by parallel cut-out slots into a plurality of optional flaps or base panels which are later folded 180° to be glued to the inner face of adjacent sidewall panels to form a reinforced base perimeter. Approximately half of the vertical balance of the blank forms the sidewalls, and the upper half forms a pair of interconnected seat/-back panels. The seat/back panels are delineated from the sidewalls by a generally W-shaped set of score lines. Generally trapezoidal sidewall panels are defined between the W score lines and the optional reinforcing base panels.

The blank has a tab at one transverse end which is fastened to the opposite side of the other end of the blank to form in cross-section an enclosed polygon, preferably a modified hexagon of unequal sides. A first of the pair of seat/back panel assemblies is folded down with one or more tabs or flaps frictionally engaging one or more of the sidewall panels. Then the second of the pair of seat/back panel assemblies is folded over the first, and an interlocking tab engages a slot in the first to complete the assembly.

In use the seat is oriented with one of the polygon (hexagon) corners forward to provide leg room on either side. A generally triangular or trapezoidal backrest panel is joined to a generally rectangular middle seat panel, and the seat portion is joined in turn to a generally triangular leg panel. The seat/back assembly is ergonomically designed for optimum comfort and lumbar (lower back) support for continuous seating over an extended period of time by having the panels oriented so the leg support is tilted upward from the horizontal, the adjoining middle seat panel is tilted downwardly from the horizontal, and the back panel is inclined backwardly from the vertical, (preferably less than 35°). The combination of the seat/back panels forms in cross-section a multi-planar C-shape concave up and tilted with its imaginary central axis at an acute angle forward from the vertical.

Once the end tab is glued to the other end to form the enclosed polygon, the assembly can be folded flat for storage or shipping. A pair of aligned apertures functioning as handholds are placed medially of the upper and lower edges of the blank, preferably in the middle seat panel toward one end thereof. By placing the handhold toward the middle of the blank, the chair blank can be carried without one end (or side) dragging on the ground. Further, the blank will be carried more securely in windy conditions as approximately half of the blank will be secured between an arm and the carrier's body, and the lower half can be pressed against the user's leg.

The backrest panel is preferably a truncated triangle (trapezoid) so that a generally triangular aperture is formed between it and the rear sidewalls. This provides a space through which a stake can be driven to keep the chair from being blown away by the wind when unoccupied. The stake may be a bare stake, a light pole of some sort, an umbrella pole for sun, shade or rain protection, or the like. Likewise, a refuse bag can be suspended in the hole to provide a handy place for disposal of paper, plastic, cans or glass refuse of the type common at picnics, concerts, beaches, and the like.

The chair is lightweight, easy to carry, stores flat and pops open for easy assembly. The solid sidewalls forming the base of the chair provide extensive area for graphics of a promotional or design nature. The sheet material can be any lightweight, high-strength, relatively rigid material such as corrugated cardboard, fiberboard, plastic, light wood (with cloth, plastic or paper webbing to join the panels), and the like. We prefer 350–450 lb test dual arch corrugated cardboard, which may be plasticized (curtain coated) to make it moisture resistant for longer life. The piece blanks can be cheaply and rapidly produced on continuous rotary die-cut presses, for example, a 5' Maramatsu press taking standard 3'×5' sheets. The wastage for the blank shown in FIG. 1 is under about 10%, and the blank may be oriented with its longitudinal axis either parallel or transverse to the long axis of the cardboard sheet, depending on the chair size desired. The blank shown may be scaled in size for children to adult sizes, and lighter weight cardboard may be used for children's sizes, if desired. Neither set-up nor take-down of the chairs requires tools. The chair is so cheap to make that it can be disposed-of after a single use. Because of its nature, the chair sheet material is ideally suited to be made from recycled material, and again recycled after use. Likewise, the used chair, as garbage, could be used for fuel.

Because of the overlapping seat/back assemblage of panels and the hexagonal ergonomic design, the chair structure does not break in extensive normal use. For example, when weight is placed in the center of the seat (on the middle seat panels), the sidewalls are drawn together, rigidifying the structure. On overuse, the chair will gradually collapse, which is a safety feature. In large crowds, such as at rock concerts, some participants become unruly. Because of the cardboard nature of the materials, the chair cannot be used as a deadly weapon.

BRIEF DESCRIPTION OF THE DRAWINGS

The invention is described below in more detail with reference to the drawings in which:

FIG. 1 illustrates the exterior side of a blank for a disposable chair in accordance with this invention;

FIG. 2A shows a right elevation of the chair in the flat (knocked-down) assembled form ready for transport or storage;

FIG. 2B shows the left elevation of the chair of FIG. 2A;

FIG. 2C shows a front elevation of the chair of FIGS. 2A and 2B in the flat condition for storage or transport;

DESCRIPTION OF THE PREFERRED EMBODIMENTS

Figure 3:
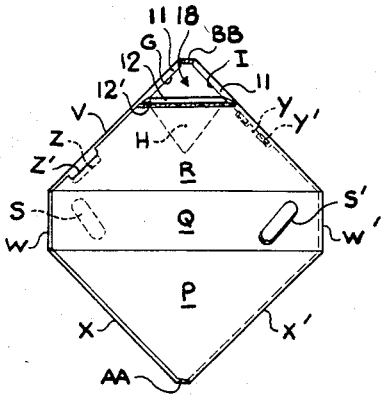
FIG. 3 is a plan view of the chair of this invention as set up for use (the front faces the bottom of the page)

The following detailed description of the preferred embodiments is by way of illustration and not by way of limitation of the general principles of this invention.

Referring now to the drawings, FIG. 1 shows a one-piece blank 1 of the chair of this invention die cut from a sheet of dual arch corrugated 400 lb test cardboard. The side shown facing the viewer in FIG. 1 becomes the exterior of the chair when assembled. As noted, the blank is generally rectangular as defined between top margin 2, 2', bottom margin 3, rear margin 4 (on the left side of FIG. 1), and assembly flap margin 5 (on the right side of FIG. 1). As noted, these margins have various cut-outs (removed portions) to define the perimeters of various panels as described in more detail below. As seen best in FIG. 1, the assembly flap M is secured to the reverse side of panel D in the area outlined by the dashed line adjacent to the rear margin 4. The assembly flap M may be fastened by glue, staples or other means to the panel D. When so assembled, the chair is then in its knocked-down or pre-setup condition, and the handle apertures S and S' in panels N and Q are aligned for carrying. This is best seen in FIGS. 2A and 2B. This is the shape of the chair for shipping, carrying or storage.

The only other panels or flaps which are glued or otherwise secured in the assembly are optional base panels A, B, C and their corresponding base panels A', B' and C'. These are folded 180° and glued or otherwise secured to the inside face of adjoining vertical wall panels D, E, F, D', E', F', respectively, to form a reinforced base for the chair. All of these reinforcing panels A, B, C, A', B', C' panels G, H, and I are optional and may be omitted although we prefer to have them to produce a stronger, more reinforced product.

It will also be noted that there is only one locking tab in the preferred embodiment. This is tab Z' formed along the upper margin 2' extending from the edge of backrest panel R. This is inserted into slot Z in the inner backrest panel K as best seen by comparing FIGS. 8, 9 and 10.

Returning to FIG. 1, the right side of the chair comprises the assemblage of panels which are identified by A-F and K, N and O (which in the drawing lie on the left). The panels forming the left side of the chair are identified in FIG. 1 for the most part with primes A'-F' (except for individual letter designations for the seat/-back assembly overlay panels P, Q and R), and these lie on the right of FIG. 1. The right side and left side of the chair assembly are joined by a front rib or webbing AA of generally rectangular configuration which joins the adjacent front right panel F to the front left panel F' along their common boundary. The width of the front rib or web AA needs only be wide enough to provide a bend in the cardboard to compensate for the multi-layer thickness in the folded condition as best seen in FIG. 2C, and so that the scoring between the front right and front left panels F and F', respectively, is not so sharp that a tear develops along that juncture under usage or handling conditions. Likewise, there is a rear rib or web BB joining the assembly flap M to the left rear sidewall panel D' which serves the same function. The front and rear rib panels or webs AA and BB are also seen in FIGS. 3, 4, 5, 9 and 10.

Figure 6:
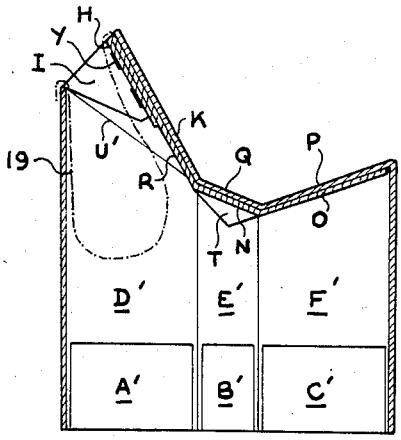
FIG. 6 is a section view along line 6—6 of FIG. 4.
Figure 7:
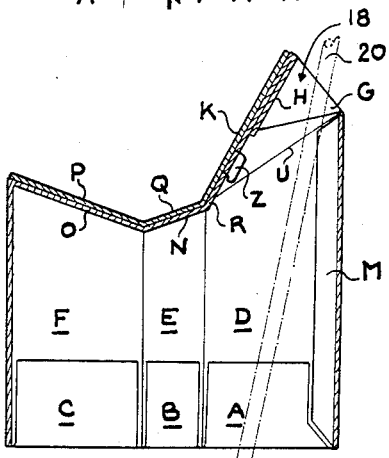
FIG. 7 is a section view of the chair of this invention along line 7—7 of FIG. 5.

Inset upwardly from the bottom margin 3 are a pair of double score lines 6, 6' which are generally parallel to the bottom margin 3. As seen, there are a series of relieved portions or cut-outs (30, 31, 32, 33, 34), which serve to define the side margins of the bottom reinforcing panels A, B, C, A', B' and C'. These bottom panels are folded 180° upwardly to be secured to the inner face of the corresponding panels to which they are attached, panels D, E, F, D', E' and F'. As seen in FIG. 1, this involves folding "downwardly" (through the plane of the figure paper) so that the hidden face of the panels A-C' are secured to the hidden face of the panels D-F'. This is shown by the arrows CC on the right and left side of FIG. 1. FIGS. 2A, 2B, 2C, 4, 5 and 8 show these base reinforcing panels glued in position along the lower margins of the sidewall panels D-F and D'-F' in dashed lines because they are hidden from the exterior view. FIGS. 6 and 7, being section views, show the panels A-C, A'-C' and M glued in position from an interior view. As noted above, these base panels A-C and A'-C' are optional but are preferred when using untreated corrugated cardboard to make a stronger product. Where it is desired to have a taller chair, the vertical height of these base panels A-C and A'-C' can be reduced. Indeed, the sidewalls D-F and D'-F' can be extended the entire width of the panels A-C and A'-C' if desired where the material strength permits for the particular lifespan projected for the chair.

The balance of the blank shown in FIG. 1 lying between the double score line 6, 6' and the top margin 2, 2' is roughly divided in half with the lower portion defining the two sets of right sidewall panels D-F and left sidewall panels D'-F'. There is a continuous but jointed set of score (fold) lines roughly in the shape of a W, which form left to right are score lines V, W, X, X', W' and V'. These divide the upper seat/back panel assemblies from the lower sidewall panel assemblies. Note that the sidewall panels are generally trapezoidal. The vertical rear right sidewall panel D is defined between margin 4 and score lines V, 7 and 6'. Center right sidewall panel E is defined between score lines 7, W, 8 and 6'. Front right sidewall panel F is defined between score lines 8, X, front rib AA, and 6'. The rear left vertical sidewall panel D' is defined between score lines 10, V', rear rib panel BB, and double score line 6'. Center left vertical sidewall panel E' is defined between score lines 9, W', 10 and 6'. Front level vertical sidewall panel F' is defined between the front rib AA and score lines X', 9 and 6'.

Note that in the upper portion of the rear right side vertical sidewall panel D and the corresponding panel D' are defined triangular panels J and L, respectively, between score lines U, 11 and V (for panel J) and U', 11' and V' (for panel L). These panels J and L are called backrest support panels, J being for the right side and L being for the left side, and have the function of providing lost motion in movement and flexing of the seat/-back panel assemblies as described in more detail below. Also, as noted above, flaps G and I are reinforcing flaps or panels to reinforce the backrest support panels J and L, respectively. They are defined between the double score lines 11 and 11' and the margin edges of the panel, respectively.

Double score lines are used when the panel is to be folded over 180° back onto the adjacent panel and secured thereto. Where the panel or flap is folded less than 180°, a single score line is used.

The optional panels G and I are preferably glued to the inside face of panels J and L, respectively. The notched margin Y' of panel I interlocks with the notched margin Y in panel K as described in more detail below.

Likewise, a triangular flap H is defined from panel K by double score line 12 and the marginal edges. Panels G and H are separated from each other by relieved slot or cut 13. Panel H is infolded and secured to the inside of panel K as an optional reinforcing panel. A preferred securing method is use of glue. Panels J, K and L may be extended into panels G, H and I, respectively, to raise the height of the back support by moving the score lines 11, 12 and 11' toward the apex of the panels G, H and I.

The upper portion of the blank 1 comprises a pair of three seat/back panel assemblies, the underneath seat/- back (lower) assembly comprising panels K, N and O being joined to the right side vertical sidewall panels DEF along score lines V, W and X. Likewise, the seat/-back overlay (upper) panel assembly comprising panels P, Q and R are joined to the left vertical sidewall panel assembly D', E' and F' along the score lines X', W' and V'. The lower legrest panel O and upper legrest panel P are generally triangular, and are joined along fold lines 14, 14' with seat panels N and Q, respectively. Seat panels N and Q are generally rectangular and have disposed adjacent score lines W and W' "stadium"-shaped apertures S and S' which function as handholds. The apertures S and S' are so disposed that they are in alignment when the assembly flap M is glued to the inside of panel D as shown in FIGS. 2A and 2B. The apertures S and S' may be disposed in the legrest panels O and P as seen in FIG. 1.

Figure 4:
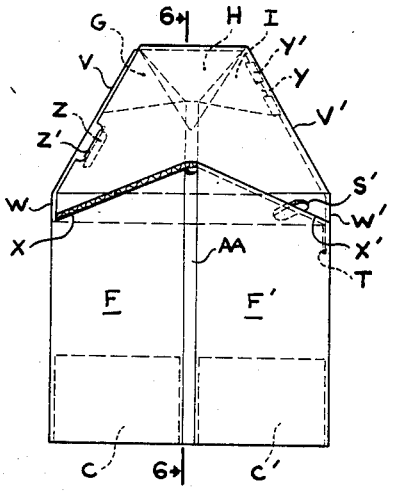
FIG. 4 is a front elevation of the chair of this invention as set up for use.
Figure 5:
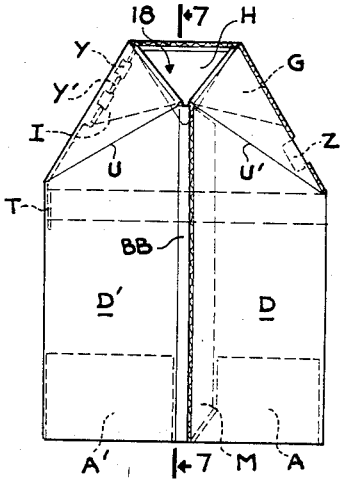
FIG. 5 is a rear elevation view of the chair of this invention as set up for use.
Figure 8:
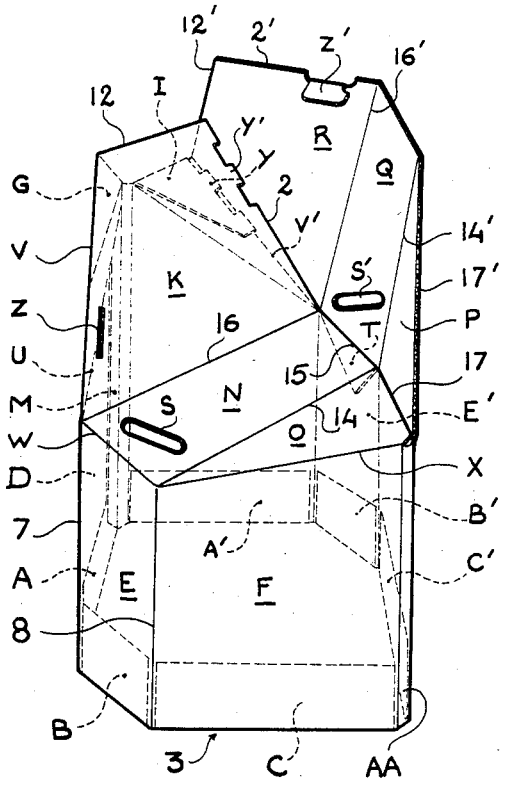
FIG. 8 is a three-quarter front right perspective view of the chair of this invention partially set up with the lower or underneath seat/back panel assembly in position before the upper seat/back assembly is folded thereover.

Adjacent the other marginal edge of panel N along fold line 15 is a triangular panel T which serves as a frictional interlock against the upper portion of the inside of panel E' when the chair is in its set-up position. This is best seen in FIGS. 4, 6 and 8. No glue is used on this panel unless the chair is desired to be set up permanently, that is, so it cannot be knocked-down and folded flat. If a permanent installation is desired, then glue may be applied to the face of flap T showing in FIG. 1. When assembled, the score line 15 abuts the score line W' on the inside face of panel E'.

The lower (underneath) backrest panel K is trapezoidal and is defined between score lines 16, V, 12 and 2. Likewise, the corresponding upper (overlay) backrest panel R is defined between score lines 16', V', margin 12' and margin 2'. As described above, locking tab of flap Z' is defined as an extension of panel R along margin 2'.

The upper portions of FIGS. 2A and 2B show how panels G, H and I are folded over and glued to the inside faces of panels J, K and L, respectively. These folded over and glued panels are also identified in FIGS. 3-7, 8 and 10. Note particularly in FIG. 10 how the notched margin Y in panel K interlocks with the notched margin Y' of panel I. This provides excellent locking support for the back. The marginal edge of panels O and P are identified with the numerals 17 and 17', respectively (FIGS. 1 and 10).

By following through on FIGS. 3-7, the various score and panel numbers and letters, the working relationship of the various panels to each other can be seen. Note particularly in FIGS. 3, 5, 6, 7 and 10 that the score lines 11, 11' and 12 form a triangular opening into which a garbage bag 19 and/or a stake or umbrella 20 can be inserted. The stake 20 can be the support pole of an umbrella (be it for rain or sun shade), a light pole or the like. Alternatively, panel H is not secured to panel K and an oval hole 27 (FIG. 1) provided therein to receive the stake 20 so that the chair is secured against movement.

Figure 9:
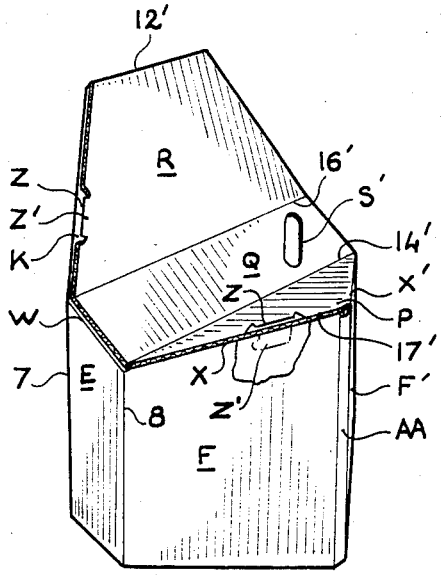
FIG. 9 is a three-quarter front right perspective of the chair of this invention in its completely set-up position after the upper seat/back panel assembly has been folded down and locked in place.

Looking now in particular at FIGS. 2A, 2B, 2C, 8, 9 and 10, the following steps are employed to set up the chair. First, the unit shown in FIGS. 2A-2C is popped open by pulling apart the two sides of the unit at the handle openings S and S' to form a three-dimensional base, the sidewalls in horizontal section view forming a modified hexagon with one acute angle facing forward, that being the angle formed between the vertical front right and left sidewall panels F and F'. As best seen in FIGS. 8 and 9, the front apex is the front rib panel or web AA joining the sidewall panels F and F'. The lower seat portion formed by the three panels K, N and O are then folded down along the score lines V, W and X as indicated in FIG. 8. The flap T is folded down along score line 15 so that its outer surface contacts the inner surface of panel E'. In the process of folding down, the panel J will flex outwardly along the score line U away from the rear right side vertical sidewall panel to permit lost motion in the folding. One or more of the upper seat/back assembly panels P, Q and R may also flex during this step. The notches Y along the marginal edge 2 of panel K will then engage the notches Y' in panel I which has been secured to the inner face of panel L. Then the upper seat/back panel assembly, panels R, Q and P, are folded down over the lower seat/back panel assembly (panels K, N and O), and the tab Z' is secured into the slot Z. In this step, the panel L will likewise flex along score line U' to permit lost motion in the folding. FIG. 9 shows the completed folding of the upper seat panel assembly, panels R, Q and P.

Figure 10:
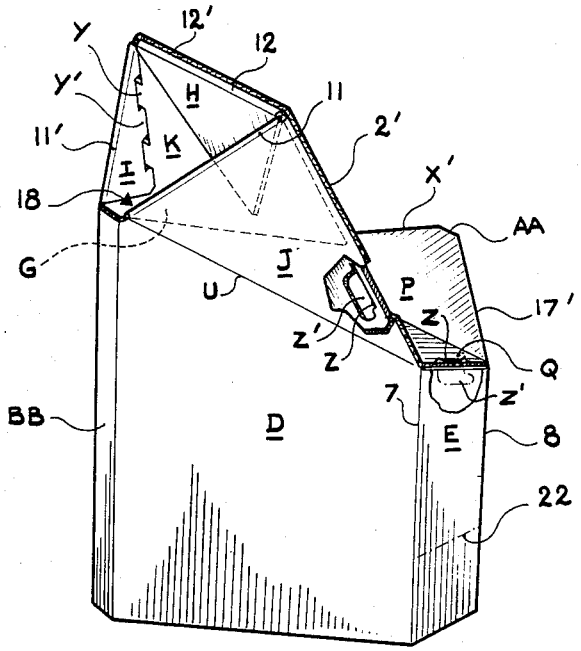
FIG. 10 is a three-quarter rear perspective view from the right side of the chair of this invention showing it in its completely set-up condition, and having a portion broken away in order to show the locking tab.

As best seen in FIG. 10, the tab Z' is then firmly locked in the slot Z in the lower seat/back assembly panel K. The panels J and L have returned to a position coplanar with the rear right and left vertical sidewall panels D and D', respectively. Note the notch 24 in tab Z' faces downwardly; when the user sits in the chair, his or her weight forces the panels Q and R downwardly engaging the end 25 of slot Z in the notch, positively locking panel R against panel K.

In use, when the user sits on the chair putting weight on the seat panel Q, the flex panels J and L actually flex inward, and the notches Y and Y' are more firmly interlocked.

To knock the chair down for storage or transport, the tab Z' is slipped upwardly and out of the slot Z, the upper seat/back panel assembly is raised, the lower seat back assembly is then lifted to a vertical position, and the two sides brought together so the assembly is again in a flat configuration as shown in FIGS. 2A through 2C.

If a permanent installation is desired, the face of tab T (as seen in FIG. 1) may be glued or otherwise fastened to the inside of panel E'. Likewise, the tab Z' can be glued to the inner face of panel J. Double-sided tape or Velcro fastening strips may be employed.

It is also possible to provide an interlock of tab T (or a modification of tab T) in the sidewalls of panel E' by providing a slot in panel E'. Likewise, tab T could be interlocked into panel Q by providing a slot therein, if desired. However, we have found that this is not necessary for occasional or short-term use of the disposable chair of this invention. We have found that in operation, the weight placed on the chair back panel R tends to urge the lower panel N to the left (as seen in FIG. 10; to the right in FIG. 9), thus urging the face of tab T against the inside of the vertical sidewall E'. This provides a sufficient frictional interlock.

Likewise, panels E and E' can be vertically shortened by the extension of slots 30, 31, 33 and 34 (defining the side margins of panels B and B') so that upon folding upward, a folded-over edge of the bottom of panels B and B' (the folded-over edge being identified in FIG. 1 as formed by fold line 21, 21') provides an additional vertical support for the side edges of panel N along score lines W and 15. In this embodiment, the flap T may be omitted. In this embodiment, as best seen in FIG. 10, panel E would only extend downwardly as fas as line 22 unless there was an extension of panels B and B' lower than the edge of the blank 3 as shown in FIG. 1.

Figure 11:
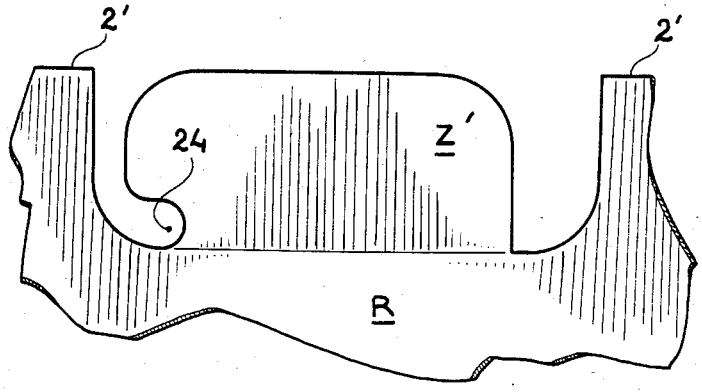
FIG. 11 is an enlarged view of the locking tab inset in the margin of a back rest panel.

FIG. 11 shows an enlarged view of an alternate embodiment of locking tab Z' which is inset along margin 21 of panel R. The corresponding slot Z would be moved inwardly in panel K away from the score line V. In this embodiment panels R and K may be widened rather than tab Z' being inset, and wastage is reduced. If the seat/back panels are widened, then all panels D-F and D'-F' must be widened proportionately.

Various other modifications and additions to the chair of this invention may be made. While it is seen that the angles from the vertical of the various panels which form the seat/back assembly (panels K, N, O, R, Q and P) are ergonomically designed to provide a most comfortable seating arrangement with excellent lumbar support, it can be appreciated that the angles may be varied somewhat depending on the intended use. For example, the backrest panels R and K may be inclined further back for a beach-type chair to provide more sun exposure. Likewise, the width of panels E, E', N and Q can be changed or eliminated entirely as desired. When the panels E and E' are either eliminated or reduced to a small webbing analogous to the webbing AA or BB, then the seat panels N and Q are likewise reduced, and the leg panels O and P are enlarged. In these cases, the tab T may be eliminated, and the larger tab 22 as shown best in FIG. 1 may be employed. In addition, it should be understood that the flap 26 may be employed in the configuration of the chair as shown in FIGS. 1–10. This would provide additional support for the leg panel P. From the ergonomic viewpoint, for greatest seating comfort we prefer keeping substantially seat panels N and Q, having the backrest panels K and R oriented at no more than 35° back from the vertical, and the legrest panels O and P at no less than 5° up from the horizontal. As shown in phantom in FIGS. 9 and 10, a locking tab Z' may be formed adjacent the margin of upper seat panel Q and/or legrest panel P which interlocks in corresponding slot Z in lower seat panel N and/or legrest panel O.

It should be understood that various modifications within the scope of this invention can be made by one or ordinary skill in the art without departing from the spirit thereof. For example, just as panels B and B' can be extended so that upon folding 180° to be secured to the inside of panels E and E', respectively, so panels A, A' and/or C, C' can be extended to meet fold lines U, U' or X, X', respectively, to provide added support to the legrest and/or backrest panels. We therefore wish our invention to be defined by the scope of the appended claims as broadly as the prior art will permit, and in view of this specification if need be.

We claim:

1. A one-piece, die-cut, prescored blank for a disposable chair comprising:

(a) a generally rectangular sheet of lightweight material having a plurality of panels defined therein by prescored fold lines;

(b) a horizontal orientation being defined in respect to said blank considered in plan view to extend between a first end assembly flap margin and a second end rear margin, and a vertical orientation being defined to extend between a top and bottom margin, said first end assembly flap margin and said second end rear margin each being generally vertical;

(c) said blank having an assembly flap defined between said assembly flap margin and a first vertical score line horizontally spaced from and generally parallel to said assembly flap margin;

(d) a plurality of vertical score lines disposed medially between said first vertical score line and said second end margin;

(e) said vertical score lines being generally parallel to each other and said end margins, and horizontally spaced from each other to define in said blank at least four vertical sidewall base panels including:
(i) a rear right sidewall base panel;
(ii) a front right sidewall base panel;
(iii) a front left sidewall base panel; and
(iv) a rear left sidewall base panel;

(f) a set of continuous score lines joined end to end extending generally horizontally between said assembly flap score line to said second end margin in a pair of V portions forming a generally W-shaped configuration, said W score lines being disposed medially of said top and bottom margins to define in an upper portion of said blank between said W score lines and said top margin a pair of adjoining legrest and backrest panels, said W score lines defining a top edge of each of said vertical side base panels, said first of said pair of legrest and backrest panels being lower legrest and backrest panels, and said second of said pair being adapted to overlie said first as upper legrest and backrest panels;

(g) at least one pair of diagonal score lines, one each extending from the intersection of each V portion of said W score line to said top margin, said diagonal score lines being inclined at their tops toward each other to define in said upper blank portion a pair of generally mirror image legrest panels and backrest panels;

(h) said upper blank portion having a generally V-shaped relieved portion disposed medially of the first and second end margin extending downwardly from said top margin to intersect the central apex juncture of the two V portions of the W score line, said relieved portion providing upper margins for said legrest panels, and one of the generally mirror image legrest and backrest panels lying on each side of the V-shaped relieved portion;

(i) said legrest panels being defined, respectively, between said upper legrest panel margin, said diagonal score line and said W score line, and said backrest panels being defined, respectively, between said top margin, said W score line and said diagonal score line;

(j) individual ones of said vertical score lines intersecting the vertexes of said two V portions of said W score line, and the central apex juncture of said two V portions of said W score line, with the vertical score line intersecting said central apex defining a front fold line;

(k) said blank, upon folding said assembly flap along said front fold line to secure said assembly flap to the obverse side of said rear right side vertical sidewall base panel in position to lap said first vertical score line parallel to said second end rear margin, forms a lightweight disposable chair having parallel sides in a knocked-down condition which may be popped-open by separating the two sides of the folded blank and folding the sides at said vertical score lines to form a base, generally diamond-shaped in plan view cross-section, with a first, front apex formed of said front fold line, of vertical sidewalls, and the legrest and backrest of said chair being formed by folding the first, lower pair of said legrest and backrest panels along said V portion fold line downwardly into engagement with the uppermost edge of opposed sidewalls, and folding the second pair of said legrest and backrest panels downwardly to overlie said first, lower pair of legrest and backrest panels, said diagonal score lines flexing so that said legrest and backrest panels form in side view cross-section an ergonomically adequate support for a human user.

2. A disposable chair blank as in claim 1 which includes:

(a) at least five vertical score lines to define six vertical sidewall base panels, said base being generally hexagonal in plan view cross-section and including a center left and a center right vertical sidewall base panel disposed intermediate said corresponding front and rear left and right panels, respectively;

(b) a second pair of diagonal score lines, one of each of which is parallel to one of said first diagonal score lines and spaced therefrom a distance corresponding to the width of said center left and center right vertical sidewall base panels, said two pairs of parallel score lines defining therebetween in said backrest panel a seat panel of generally rectangular configuration, said legrest panel, said seat panel and said backrest panel forming in side view cross-section a multiplanar, C-shaped seating assembly.

3. A disposable chair blank as in claim 2 wherein:

(a) a first handhold aperture is provided in said upper seat panel;

(b) a second handhold aperture is provided in said lower seat panel; and (c) said handhold apertures are aligned and disposed adjacent the vertex of said V portion score lines so that said blank may be carried in the flat configuration with one hand through both apertures and tucked between the body and carrying arm.

4. A disposable chair blank as in claim 2 which includes:

(a) a pair of generally triangular backrest support panels each of which is defined between a diagonal score line in said rear vertical sidewall base panel extending from the vertex of the V portion of the W score line to said adjacent first vertical score line and to said second end margin, respectively, said support panels flexing outwardly when said legrest, seat and backrest panels are folded downwardly into use positions, and said support panels flexing inwardly when the user sits in said chair.

5. A disposable chair blank as in claim 4 which includes:

(a) at least one lock tab disposed in a panel selected from one or more of the overlying upper legrest, seat and backrest panels; and (b) a slot for receiving each of said lock tabs in the corresponding lower legrest, seat and backrest panels.

6. A disposable chair blank as in claim 5 wherein:

(a) said lock tab is a single locking tab disposed adjacent the top margin of said overlying upper backrest panel; and (b) said slot is disposed in said lower backrest panel adjacent said V portion score line.

7. A disposable chair blank as in claim 5 which includes:

(a) at least one support tab defined in the margins of one of said lower seat and legrest panels; and (b) said tab, upon being folded downwardly, frictionally engages the inner sidewall of the respective abutting center and front vertical sidewall base panel adjacent its upper edge to provide additional seating support, said tab being adaptable to being secured to said sidewall where permanent erection of said chair is desired.

8. A disposable chair blank as in claim 5 which includes;

(a) generally triangular reinforcing flaps disposed joining each of said backrest support panels between a pair of closely spaced parallel diagonal score lines generally perpendicular to said V portion score lines and, respectively, said first vertical score line and said second end margin;

(b) said reinforcing flaps being folded back 180° and secured to the inner face of their respective backrest support panels;

(c) one of said reinforcing flaps being notched along its upper margin; and (d) said lower backrest panel being notched along its upper margin to mate with the notches in said reinforcing flap to provide support for said lower backrest panel.

9. A disposable chair blank as in claim 8 wherein:

(a) said lower backrest panel has joined thereto along at least one diagonal score line a generally triangular panel, said just aforementioned diagonal score line extending from said upper margin to the juncture of said reinforcing flap score line with said V portion score line.

10. A disposable chair blank as in claim 9 which includes:

second score line closely spaced and parallel to said triangular backrest panel first score line permitting said generally triangular panel to be folded back 180° and secured to the inner face of said lower backrest panel as a reinforcing panel.

11. A disposable chair blank as in claim 9 wherein said triangular panel contains a hole for placement therethrough of an umbrella stake.

12. A disposable chair blank as in claim 8 which includes:

(a) a pair of closely spaced parallel score lines spaced upwardly from said bottom margin in said vertical sidewall base panels;

(b) a plurality of vertical relieved segments coaxial with said vertical score lines extending downwardly from said pair of first aforementioned parallel score lines to said bottom margin to define therebetween a plurality of bottom flaps, one corresponding to each vertical sidewall panel;

(c) said bottom flaps functioning, upon being folded 180° along said just aforementioned parallel score lines and secured to the inner faces of said vertical sidewall panels, to reinforce the bottom edge of said chair defined by said pair of just aforementioned parallel score lines.

13. A method of setting-up the blank of claim 12 having said assembly flap secured to said vertical sidewall rear base panel to form a chair comprising the steps of:

(a) spreading apart the adjacent vertical sidewalls to form a chair base generally diamond-shaped in plan view cross-section;

(b) flexing outwardly said backrest support flex panel while folding downwardly said lower legrest and backrest panels so that the upper marginal edges thereof engage the upper edges of the opposed vertical sidewalls;

(c) folding downwardly said upper legrest and backrest panels to overlie said lower legrest and backrest panels; and (d) engaging said lock tab in said corresponding slot.

14. A disposable chair blank as in claim 12 wherein said front fold and said first vertical score lines each have a second closely spaced parallel score line to permit bending said blank material >90° without substantial weakening due to overstressing said material.

15. A disposable chair blank as in claim 14 wherein:

(a) said backrest panels are generally trapezoidal, and said backrest support flex panels are generally triangular to define therebetween in the set-up position of the chair a triangular opening; and (b) means for retaining objects disposed in said chair with access thereinto through said triangular opening.

16. A lightweight disposable chair of the blank of claim 14.

17. A disposable chair blank as in claim 2 which includes:

(a) at least one lock tab disposed in a panel selected from one or more of the overlying upper legrest, seat and backrest panels; and (b) a slot for receiving each of said lock tabs in the corresponding lower legrest, seat and backrest panels.

18. A disposable chair blank as in claim 17 wherein:

(a) a first handhold aperture is provided in said upper seat panel;

(b) a second handhold aperture is provided in said lower seat panel; and (c) said handhold apertures are aligned and disposed adjacent the vertex of said V portion score lines so that said blank may be carried in the flat configuration with one hand through both apertures and tucked between the body and carrying arm.

19. A method of setting-up the blank of claim 17 having said assembly flap secured to said vertical sidewall rear base panel to form a chair comprising the steps of:

(a) spreading apart the adjacent vertical sidewalls to form a chair base generally diamond-shaped in plan view cross-section;

(b) folding downwardly said lower legrest and backrest panels so that the upper marginal edges thereof engage the upper edges of the opposed vertical sidewalls;

(g) folding downwardly said upper legrest and backrest panels to overlie said lower legrest and backrest panels; and (d) engaging said lock tab in said corresponding slot.

20. A disposable chair blank as in claim 17 which includes:

(a) a pair of closely spaced parallel score lines spaced upwardly from said bottom margin in said vertical sidewall base panels;

(b) a plurality of vertical relieved segments coaxial with said vertical score lines extending downwardly from said pair of just aforementioned parallel score lines to said bottom margin to define therebetween a plurality of bottom flaps, one corresponding to each vertical sidewall panel;

(c) said bottom flaps functioning, upon being folded 180° along said just aforementioned parallel score lines and secured to the inner faces of said vertical sidewall panels to reinforce the bottom edge of said chair defined by said pair of just aforementioned parallel score lines.

21. A disposable chair blank as in claim 16 wherein:

(a) said relieved segments coaxial with the vertical score lines forming the vertical edges of said central vertical sidewall panels are relieved above the just aforementioned parallel score lines sufficiently far that when the bottom reinforcing flaps produced therebetween are folded to be secured to the inner face of said central panels, the bottom margin is positioned adjacent the corresponding V portion fold line forming the upper edge of said central panels; and (b) said bottom margin of said central panels are cut diagonally so that the margin lies parallel to said V portion fold line to support said seat panels in contact therewith.

22. A disposable chair blank as in claim 20 wherein:

(a) a first handhold aperture is provided in said upper seat panel;

(b) a second handhold aperture is provided in said lower seat panel; and (c) said handhold apertures are aligned and disposed adjacent the vertex of said V portion score lines so that said blank may be carried in the flat configuration with one hand through both apertures and tucked between the body and carrying arm.

23. A lightweight disposable chair of the blank of claim 20.

24. A disposable chair blank as in claim 1 which includes:

(a) at least one lock tab disposed in a panel selected from one or more of the overlying upper legrest, seat and backrest panels; and (b) a slot for receiving each of said lock tabs in the corresponding lower legrest, seat and backrest panels.

25. A disposable chair blank as in claim 24 which includes:

(a) a pair of closely spaced parallel score lines spaced upwardly from said bottom margin in said vertical sidewall base panels;

(b) a plurality of vertical relieved segments coaxial with said vertical score lines extending downwardly from said pair of just aforementioned parallel score lines to said bottom margin to define therebetween a plurality of bottom flaps, one corresponding to each vertical sidewall panel;

(c) said bottom flaps functioning, upon being folded 180° along said just aforementioned parallel score lines and secured to the inner faces of said vertical sidewall panels, to reinforce the bottom edge of said chair defined by said pair of just aforementioned parallel score lines.

26. A lightweight disposable chair of the blank of claim 25.

27. A lightweight disposable chair of the blank of claim 1.

28. A disposable chair blank as in claim 1 wherein:

(a) a first handhold aperture is provided in at least one of said upper legrest and backrest panels;

(b) a second handhold aperture is provided in at least one of said lower legrest and backrest panels; and (c) said second handhold aperture being aligned with said first aperture so that said blank may be carried in the flat configuration with one hand through both said apertures.

29. Method of setting-up the blank of claim 1 having said assembly flap secured to said vertical sidewall rear base panel to form a chair comprising the steps of:

(a) spreading apart the adjacent vertical sidewalls to form a chair base generally diamond-shaped in plan view cross-section;

(b) folding downwardly said lower legrest and backrest panels so that the upper marginal edges thereof engage the upper edges of the opposed vertical sidewalls; and (c) folding downwardly said upper legrest and backrest panels to overlie said lower legrest and backrest panels.

* * * * *